US011203839B2

(12) United States Patent
Woergoetter

(10) Patent No.: US 11,203,839 B2
(45) Date of Patent: Dec. 21, 2021

(54) MACHINE, MOBILE ON A TRACK, FOR REMOVING IRREGULARITIES ON A RAIL HEAD SURFACE

(71) Applicant: PLASSER & THEURER EXPORT VON BAHNBAUMASCHINEN GESELLSCHAFT M.B.H., Vienna (AT)

(72) Inventor: Herbert Woergoetter, Engerwitzdorf (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 364 days.

(21) Appl. No.: 16/330,460

(22) PCT Filed: Aug. 9, 2017

(86) PCT No.: PCT/EP2017/000967
§ 371 (c)(1),
(2) Date: Mar. 5, 2019

(87) PCT Pub. No.: WO2018/046115
PCT Pub. Date: Mar. 15, 2018

(65) Prior Publication Data

US 2019/0218726 A1 Jul. 18, 2019

(30) Foreign Application Priority Data

Sep. 7, 2016 (AT) ..... A 413/2016

(51) Int. Cl.
*E01B 31/12* (2006.01)

(52) U.S. Cl.
CPC ..... *E01B 31/12* (2013.01)

(58) Field of Classification Search
CPC ..... E01B 31/12; E01B 31/02; E01B 31/13; E01B 31/17
See application file for complete search history.

(56) References Cited

U.S. PATENT DOCUMENTS

| | | | |
|---|---|---|---|
| 4,074,468 | A | 2/1978 | Panetti |
| 4,461,604 | A | 7/1984 | Theurer et al. |
| 4,583,895 | A | 4/1986 | Theurer |

(Continued)

FOREIGN PATENT DOCUMENTS

| | | | |
|---|---|---|---|
| AT | 368215 | B | 9/1982 |
| AT | 369071 | B | 12/1982 |

(Continued)

*Primary Examiner* — Rick K Chang
(74) *Attorney, Agent, or Firm* — Laurence A. Greenberg; Werner H. Stemer; Ralph E. Locher

(57) ABSTRACT

A rail treatment machine, mobile on a track, for removing irregularities on a rail head surface of at least one rail of a laid track, includes a machine frame supported on a front on-track undercarriage and a rear on-track undercarriage, as seen in a working direction. A tool frame accommodates at least one tool carrier. A rear end of the tool frame is articulated on the rear on-track undercarriage in an articulation point on a vertical axis of rotation. A front end of the tool frame is supported on a separate on-track undercarriage situated between the front on-track undercarriage and the rear on-track undercarriage.

15 Claims, 4 Drawing Sheets

(56) References Cited

U.S. PATENT DOCUMENTS

| | | | | |
|---|---|---|---|---|
| 6,638,138 | B1 * | 10/2003 | Luddeneit | E01B 31/17 451/5 |
| 6,746,307 | B2 | 6/2004 | Knoll et al. | |

FOREIGN PATENT DOCUMENTS

| | | | |
|---|---|---|---|
| AT | 369456 | B | 1/1983 |
| AT | 513035 | B1 | 1/2014 |
| CH | 636392 | A5 | 5/1983 |
| CN | 1484723 | A | 3/2004 |
| CN | 102345257 | A | 2/2012 |
| WO | 0206587 | A1 | 1/2002 |

* cited by examiner

MACHINE, MOBILE ON A TRACK, FOR REMOVING IRREGULARITIES ON A RAIL HEAD SURFACE

FIELD OF TECHNOLOGY

The invention relates to a rail treatment machine, mobile on a track, for removing irregularities on a rail head surface of at least one rail of a laid track, including a machine frame supported on a front on-track undercarriage and on a rear on-track undercarriage, as seen in a working direction, and a tool frame for accommodating at least one tool carrier.

PRIOR ART

Rail treatment machines for treating a rail head surface are already known from a variety of patent applications. In these, the flaws present in the rail level surface are removed by means of a machining treatment tool.

AT 513 035 B1 thus describes a device for grinding rails of a track, in which grinding stones associated in each case with one rail are provided which are arranged one following the other in the longitudinal direction of the rail, wherein each grinding stone is adjustable by means of a drive in vertical direction, or toward a rail running surface.

Known from AT 369 456 B is a treatment machine in which a tool carrier is articulatedly connected to a machine frame via a hydraulic piston-cylinder unit.

By arranging the treatment tools in relation to the rail vehicle, and in particular to the on-track undercarriages or rigid axles, misalignments relative to the laid track occur especially during travel in curves and in the case of track super-elevations in the curves.

SUMMARY OF THE INVENTION

It is the object of the present invention to provide a device of the type mentioned at the beginning which enables a precise adjustment of the treatment tools to the track geometry, and a cost-effective and economical track treatment.

According to the invention, this object is achieved in that the machine frame is supported on a front on-track undercarriage and on a rear on-track undercarriage, as seen in the working direction, and that a rear end of the tool frame is articulatedly mounted on the rear on-track undercarriage in an articulation point on a vertical axis of rotation, and a front end of the tool frame is supported on a separate on-track undercarriage situated between the front on-track undercarriage and the rear on-track undercarriage.

This configuration ensures an adjustment of the tool frame, and thus of the treatment tool, to the track geometry independently of the machine frame. With this, a high surface quality of the rails and, as a result, a reduction of noise during travel is achieved.

A useful further development provides that the rear on-track undercarriage is designed as a bogie, and that the machine frame is supported on the bogie for rotation about the vertical axis of rotation.

Based on this arrangement of the articulatedly supported articulation point on the vertical axis of rotation of the rear on-track undercarriage, an effective adaptation to curve radii and track super-elevations is possible with simple structural means.

A further advantage exists if the rear on-track undercarriage is designed as a braced bogie. In this, vibrations of the bogie frame relative to the wheel axles are suppressed by means of bracing elements. Thus it is possible to ensure a higher precision of material ablation in a working position of the treatment tool.

It is additionally advantageous if the separate on-track undercarriage of the tool frame is designed as a braced bogie. In this, it is favourable if bracing elements at the respective braced bogie can be activated by means of a control, especially for a work run. It is then possible to shut off the respective bracing during transfer travel in order to improve the drive characteristics of the rail treatment machine.

In an advantageous further development it is provided that a pivotable chip collector located above the tool frame is arranged on the machine frame. This makes it possible to collect the whole of the chips removed from the rail surface in order to thereafter unload them, as needed, in a targeted and environmental-friendly way at an unloading spot provided for this purpose beside the track, or on a loading surface of a truck or transport wagon.

A further embodiment of the invention provides that a treatment tool located on the tool carrier has a floating mount. In combination with the bracing of the rear on-track undercarriage and of the separate on-track undercarriage, this effects an independent adaptation of the tool frame to both rails.

A useful design is realized in that a treatment tool located on the tool carrier is configured as a milling tool. This makes it possible to achieve a substantial material removal, for example in the event of groove formation.

A further embodiment provides that a treatment tool located on the tool carrier is configured as a grinding tool. With this, a particularly high surface quality of the rail head can be realized.

An additional advantage exists if the treatment tool is designed to be pivotable from a transport position into a working position. This greatly facilitates the mobility during transfer travel.

It is further also advantageous if the treatment tool in each case is equipped with a separate drive. Thus, no central drive of the machine is required, and the treatment tool can be operated independently.

It is useful if the drive is designed to be hydraulic. This leads to simple controlling concepts for optimal utilization of the drive motor in the event of greatly varying performance requirements of the work machine.

Another embodiment provides that the drive is designed to be electric. In this case, the advantages clearly are the simple design and the elimination of a separate hydraulic system.

It is further favourable if the machine is designed as a traction vehicle having a separate motor. With this, there would be no necessity of an additional traction vehicle for mobility on the track.

BRIEF DESCRIPTION OF THE DRAWINGS

The invention will be described by way of example below with reference to the attached figures. There is shown in schematic representation in.

DESCRIPTION OF THE EMBODIMENTS

Figure 1:
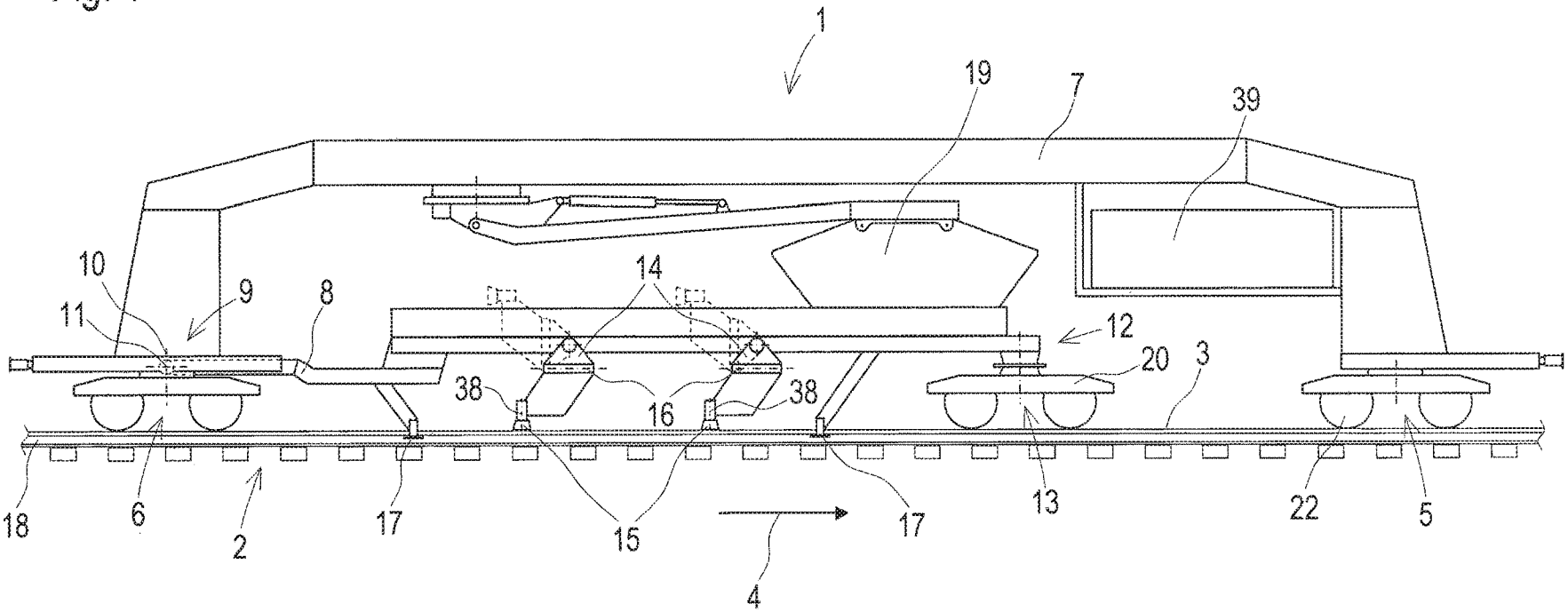
FIG. 1 a side view of the machine mobile on a track
FIG. 2 a detail view of a braced bogie without bracing
FIG. 3 a detail view of a braced bogie with bracing
FIG. 4 a side view of a mount of the articulation point
FIG. 5 a top view of the mount of the articulation point.

A machine 1, shown in FIG. 1 and mobile on a track 2, for removing irregularities on a rail head surface 3 comprises a machine frame 7 supported on a front on-track undercarriage 5 and a rear on-track undercarriage 6, as seen in a working direction 4. At a rear end 9, a tool frame 8 is articulatedly mounted above the rear on-track undercarriage 6 on a vertical axis of rotation 10 in an articulation point 11 and supported with a front end 12 on a separate on-track undercarriage 13 situated between the front on-track undercarriage 5 and the rear on-track undercarriage 6.

The rear on-track undercarriage 6 and the separate on-track undercarriage 13 are designed as braced bogies. Arranged on the tool frame 8 are two tool carriers 14, pivotable from a transport position into a working position, along with treatment tools 15 having floating mounts 16. Provided underneath the tool frame 8 are guide rollers 17 for an optimal course of the treatment tools 15 along the rails 18.

A chip collector 19 pivotable about an axis is arranged between the machine frame 7 and tool frame 8. For emptying, the chip collector 19 is lifted by means of a lifting arm and pivoted laterally about the axis.

FIG. 1 depicts a working position, shown in full lines, and a transport position, shown in dashed lines, of the tool carriers 14 and treatment tools 15. Favourably, each treatment tool can be actuated with a separate drive 38.

A supply installation 39 for supplying the drives 38 of the treatment tools 15 is provided underneath the machine frame 7. This is, for example, a combustion engine which, via a transmission, drives hydraulic pumps of a hydraulic system or a generator.

Figure 2:
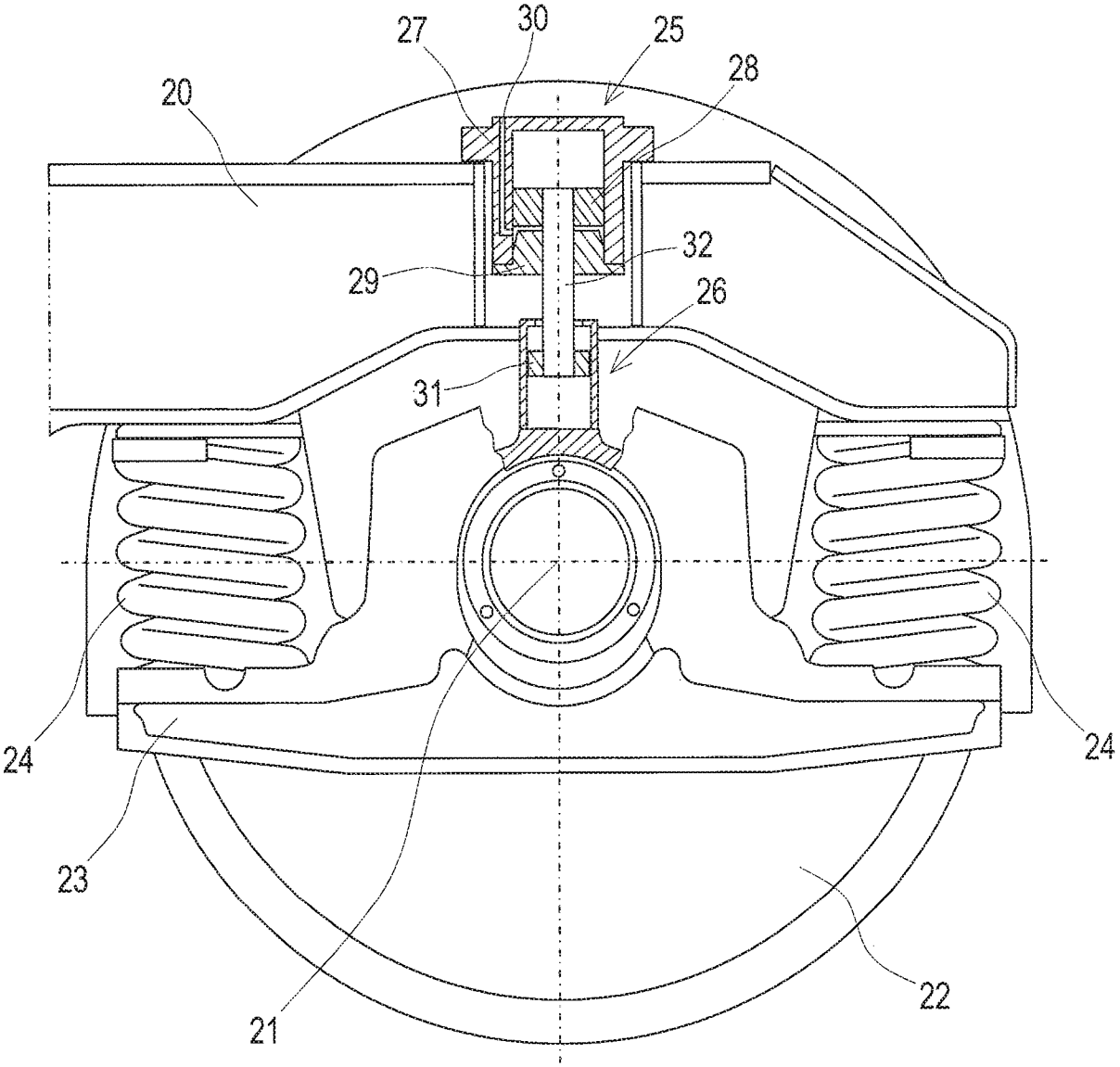
Figure 3:
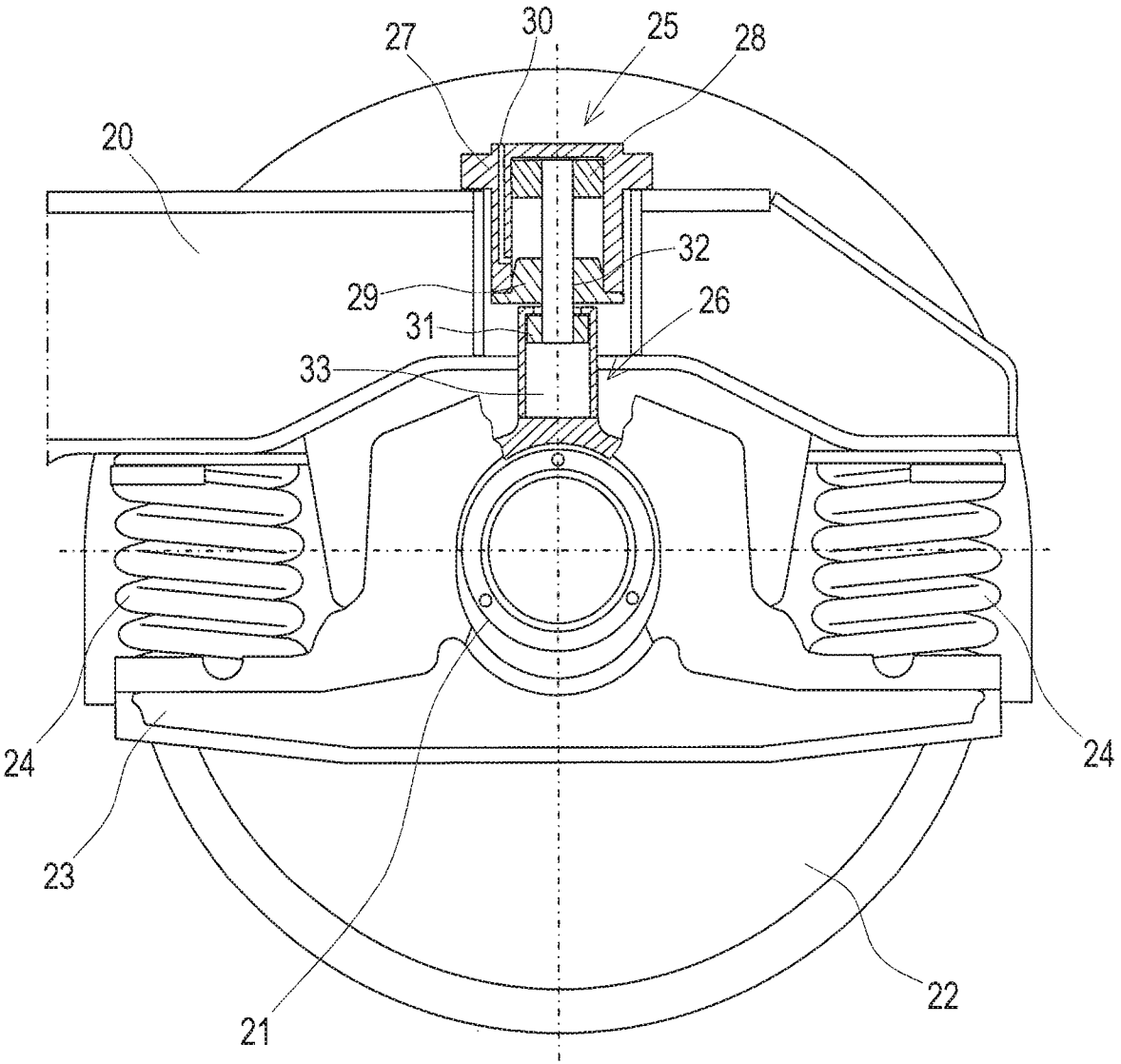

Shown in FIG. 2 and FIG. 3 in each case is a detail view of the braced bogies. The respective braced bogie comprises a bogie frame 20 and rail wheels 22 arranged on two wheel axles 21. Two springs 24 are positioned between the bogie frame 20 and a spring plate 23 arranged at either side below the respective wheel axle 21.

A hydraulic cylinder 25 and, at the associated spring plate 26 or the axle mount, a second cylinder 26 without hydraulics are arranged as bracing elements on the bogie frame 20 per wheel suspension. Located in a cylinder wall 27 of the hydraulic cylinder 25 is a hydraulic line 30 running between a first piston 28 and a cylinder bottom 29. In the second cylinder 26, a second piston 31 is arranged, and the latter is connected to the first piston 28 by means of a piston rod 32.

In FIG. 2, the bogie is in a relaxed state and is thus not actuated by pressure via the hydraulic line 30. The first piston 28 is in a lowered state, and the springs 24 are thus not pre-stressed. The bracing of the respective bogie is thus deactivated.

Shown in FIG. 3 is an activated bracing. Here, the hydraulic cylinder 25 is actuated with pressure via the hydraulic line 30, so that the first piston 28 is pushed upward. The second piston 31, connected via the piston rod 32 to the first piston 28, is forcibly moved in the direction of the hydraulic cylinder 25 and pre-stresses the springs 24. The pre-stressing of the springs 24 effects a more stable support and thus a more precise treatment of the rail head surface 3.

Figure 4:
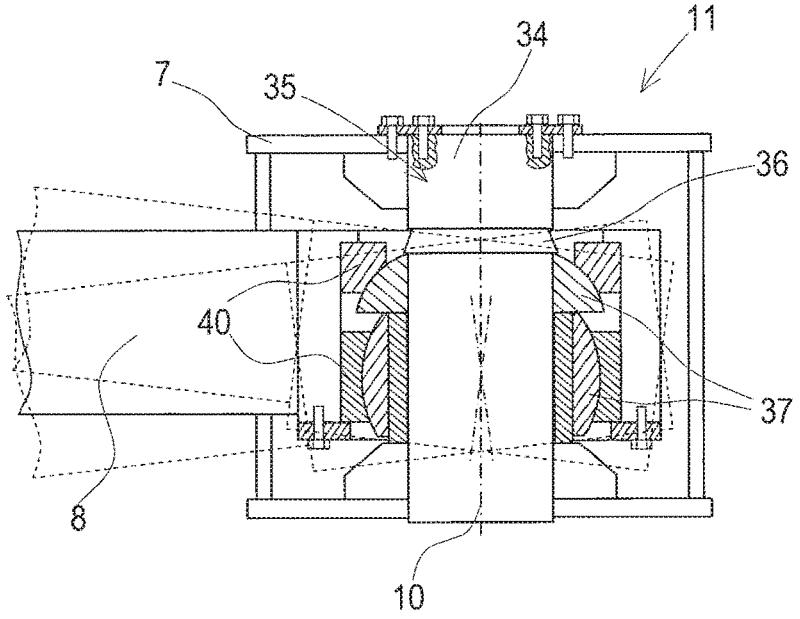
Figure 5:
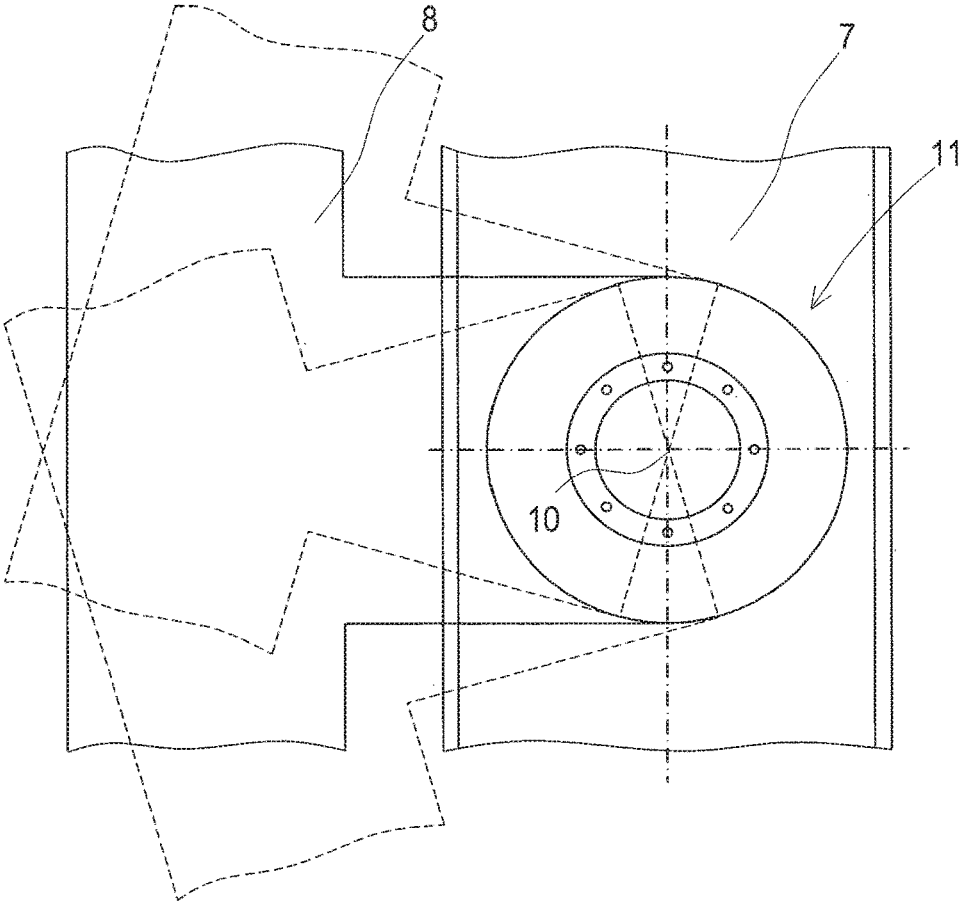

Shown in FIG. 4 and FIG. 5 is the mounting in the articulation point 11. The rear end 9 of the tool frame 8 is articulatedly mounted on a guide bolt 34 located on a vertical axis of rotation 10. The guide bolt 34 is fixed in the machine frame 7 and has at its upper end 35 a conically shaped recess 36 which serves as a stop for the tool frame 8.

Arranged around the guide bolt 34 are bearing shells 37 having spherical outer surfaces, with the articulation point 11 being the common center point. In the tool frame 8, bearing shells 40 having corresponding spherical inner surfaces are arranged, so that free tilting- and rotating motions of the tool frame 8 around the articulation point 11 are possible.

In FIG. 5, the freedom of motion of the tool frame 8 relative to the machine frame 7 in a horizontal plane is shown. Thus, the treatment tools 15 are able to follow the rails 18 even in tight curve radii.

The invention claimed is:

1. A track-bound rail treatment machine for removing irregularities on a rail head surface of a rail of a laid track, the rail treatment machine comprising:

a machine frame supported on a forward on-track undercarriage and on a rear on-track undercarriage, as seen in a working direction of the rail treatment machine;

a tool frame for accommodating at least one tool carrier;

said tool frame having a rear end articulatedly mounted on said rear on-track undercarriage at an articulation point about a vertical axis of rotation; and said tool frame having a front end supported on a separate on-track undercarriage disposed between said front on-track undercarriage and said rear on-track undercarriage;

said rear on-track undercarriage being a bogie, and said machine frame being supported on said bogie for rotation about the vertical axis of rotation.

2. The rail treatment machine according to claim 1, wherein each said rear on-track undercarriage and said separate on-track undercarriage of said tool frame is a braced bogie, and each said braced bogie comprises bracing elements to be activated by way of a control for a work run.

3. The rail treatment machine according to claim 1, wherein said rear on-track undercarriage is a braced bogie.

4. The rail treatment machine according to claim 1, wherein said separate on-track undercarriage of said tool frame is a braced bogie.

5. The rail treatment machine according to claim 4, wherein said braced bogie comprises bracing elements to be activated by way of a control for a work run.

6. The rail treatment machine according to claim 1, further comprising guide rollers disposed to additionally guide said tool frame along the rail.

7. The rail treatment machine according to claim 1, further comprising a pivotable chip collector mounted on said machine frame above said tool frame.

8. The rail treatment machine according to claim 1, further comprising a floating mount supporting a treatment tool on said tool carrier.

9. The rail treatment machine according to claim 8, wherein said treatment tool is pivotally mounted between a transport position and a working position.

10. The rail treatment machine according to claim 8, wherein said treatment tool in each case is equipped with a separate drive.

11. The rail treatment machine according to claim 10, wherein said separate drive is an hydraulic drive.

12. The rail treatment machine according to claim 10, wherein said separate drive is an electric drive.

13. The rail treatment machine according to claim 1, wherein a treatment tool located on the tool carrier is configured as a grinding tool.

14. A track-bound rail treatment machine for removing irregularities on a rail head surface of a rail of a laid track, the rail treatment machine comprising:

a machine frame supported on a forward on-track undercarriage and on a rear on-track undercarriage, as seen in a working direction of the rail treatment machine;

a tool frame for accommodating at least one tool carrier;

said tool frame having a rear end articulatedly mounted on said rear on-track undercarriage at an articulation point about a vertical axis of rotation;

said tool frame having a front end supported on a separate on-track undercarriage disposed between said front on-track undercarriage and said rear on-track undercarriage; and a treatment tool being a milling tool supported on said tool carrier.

15. A track-bound rail treatment machine for removing irregularities on a rail head surface of a rail of a laid track, the rail treatment machine comprising:

a machine frame supported on a forward on-track undercarriage and on a rear on-track undercarriage, as seen in a working direction of the rail treatment machine;

a tool frame for accommodating at least one tool carrier;

said tool frame having a rear end articulatedly mounted on said rear on-track undercarriage at an articulation point about a vertical axis of rotation; and said tool frame having a front end supported on a separate on-track undercarriage disposed between said front on-track undercarriage and said rear on-track undercarriage; and wherein said separate on-track undercarriage of said tool frame is a braced bogie.

* * * * *